US009802115B2

(12) United States Patent
Cortenraad et al.

(10) Patent No.: US 9,802,115 B2
(45) Date of Patent: Oct. 31, 2017

(54) GAME BOARD, PAWN, STICKER AND SYSTEM FOR DETECTING PAWNS ON A GAME BOARD

(75) Inventors: Hubertus Maria Rene Cortenraad, Eindhoven (NL); Rogier Winters, Heerlen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 2268 days.

(21) Appl. No.: 11/575,317

(22) PCT Filed: Sep. 8, 2005

(86) PCT No.: PCT/IB2005/052924

§ 371 (c)(1),
(2), (4) Date: Mar. 15, 2007

(87) PCT Pub. No.: WO2006/033036

PCT Pub. Date: Mar. 30, 2006

(65) Prior Publication Data

US 2008/0058045 A1 Mar. 6, 2008

(30) Foreign Application Priority Data

Sep. 21, 2004 (EP) ..... 04104562

(51) Int. Cl.
*A63F 3/00* (2006.01)
*A63F 9/24* (2006.01)
(Continued)

(52) U.S. Cl.
CPC ..... *A63F 3/00643* (2013.01); *A63F 2003/00662* (2013.01); *A63F 2009/242* (2013.01); *A63F 2009/2425* (2013.01); *A63F 2250/20* (2013.01)

(58) Field of Classification Search
CPC ..... A63F 3/00643; A63F 2003/00662; A63F 2009/2425; A63F 2250/20; A63F 2009/242
(Continued)

(56) References Cited

U.S. PATENT DOCUMENTS 4,235,442 A * 11/1980 Nelson ..... 273/237
4,541,633 A * 9/1985 Newbill ..... 273/238
(Continued)

FOREIGN PATENT DOCUMENTS

CN 1163579 A 10/1997
EP 1158775 A1 11/2001
(Continued)

OTHER PUBLICATIONS

P. Steurer and MB Srivastava: "System Design of Smart Table", http://nesl.ee.ucla.edu/projects/smartkg/docs/PerCom2003_Smart-Table.pdf. 2004.
(Continued)

*Primary Examiner* — Omkar Deodhar
*Assistant Examiner* — Wei Lee

(57) ABSTRACT

A game board (2) with a board surface (3) and a scanning display, the scanning display comprises display means for displaying a game board layout on the board surface (3), and detection means for scanning a code surface of a pawn (20) for detecting a pawn code when the code surface of the pawn (20) is directed towards the board surface (3). The game board (2) further comprises or is coupled to a memory (6) for storing a set of codes, and a processor (5) for comparing the detected pawn code to the stored codes to identify the pawn (20). The detection means preferably comprise a plurality of light sensors (12).

11 Claims, 6 Drawing Sheets

(51) Int. Cl.
*A63F 13/00* (2014.01)
*G06F 17/00* (2006.01)
*G06F 19/00* (2011.01)

(58) Field of Classification Search
USPC ..... 463/30; 273/236–239
See application file for complete search history.

(56) References Cited

U.S. PATENT DOCUMENTS

| | | | | |
|---|---|---|---|---|
| 5,013,047 | A * | 5/1991 | Schwab | 273/238 |
| 5,313,055 | A * | 5/1994 | Shiratsuki et al. | 250/208.1 |
| 5,462,281 | A * | 10/1995 | Gaito et al. | 273/238 |
| 5,929,845 | A | 7/1999 | Wei et al. | |
| 6,190,174 | B1 * | 2/2001 | Lam | 434/169 |
| 6,761,634 | B1 * | 7/2004 | Peterson et al. | 463/30 |
| 2003/0156100 | A1 | 8/2003 | Gettemy | |
| 2005/0096981 | A1 * | 5/2005 | Shimada | 705/14 |
| 2005/0258252 | A1 * | 11/2005 | Winter et al. | 235/472.02 |

FOREIGN PATENT DOCUMENTS

| | | | |
|---|---|---|---|
| JP | 63040589 | A | 2/1988 |
| JP | 5023438 | A | 2/1993 |
| JP | 5252344 | A | 9/1993 |
| JP | 3053780 | | 8/1998 |
| JP | 2000288156 | A | 10/2000 |
| JP | 2001259110 | A | 9/2001 |
| JP | 2002237923 | A | 8/2002 |
| WO | 9603188 | A1 | 2/1996 |
| WO | 03061008 | A1 | 7/2003 |
| WO | 2006033036 | A2 | 3/2006 |

OTHER PUBLICATIONS

J. A. Paradiso et al: "Sensor Systems for Interactive Surfaces", IBM Systems Journal, vol. 39, No. 3&4, pp. 892-914, http://www.research.ibm.com/journal/sj/393/part3/paradiso.html.

Masanori Sugimoto et al: "Supporting Face-to-Face Group Activities", http://pages.cpsc.ucalgary.ca/~sdscott/cscw/cscw2000/cscw_sugimoto.pdf. 2004.

Ullmer and Ishii: "The Metadesk: Models and Prototypes", Proceedings of UIST '97, pp. 1-10, http://xenia.media.mit.edu/~ullmer/papers/metadesk/uist97-desk.pdf.

* cited by examiner

GAME BOARD, PAWN, STICKER AND SYSTEM FOR DETECTING PAWNS ON A GAME BOARD

The invention relates to a game board comprising a board surface, the game board comprising means for detecting a pawn which is positioned on the game board.

The invention also relates to a pawn, a sticker for applying to a pawn and a system for playing board games, the system comprising a game board and at least one pawn.

The concept of recognizing objects on tables or desks, with or without a display is known from systems which comprise video cameras which are positioned above the desk and use object recognition software for identifying and locating objects on the desk. A major drawback of such systems is that the view of the cameras may be obscured by the user, especially when a user reaches for a pawn for making a move. Furthermore, ambient lighting may negatively influence the quality of the object recognition, making such systems less useful for playing board games outside or in dark rooms. When playing outside, also the placement of the camera may be problematic.

It is an object of the invention to provide a game board, a pawn and a system for playing board games, which enables reliably detecting pawns on a game board.

According to a first aspect of the invention a game board is provided comprising a board surface and a scanning display, the scanning display comprising display means for displaying a game board layout on the board surface and detection means for scanning a code surface of a pawn for detecting a pawn code when the code surface of the pawn is directed towards the board surface.

In an embodiment of the invention, the game board further comprises a memory for storing a set of stored codes and a processor for comparing the detected pawn code to at least one stored code of the set of stored codes to identify the pawn. An embodiment of the game board according to the first aspect of the invention may be coupled to a computer comprising the memory and the processor, for enabling identifying the pawn which comprises the detected pawn code.

According to a third aspect of the invention a pawn is provided comprising a code surface, the code surface comprising a pawn code for identifying the pawn, the code surface being directed towards a board surface of a game board if the pawn is positioned on the board surface for enabling detection of the pawn code by the game board.

According to a fourth aspect of the invention a system for playing board games is provided comprising a game board and at least one pawn according to the invention.

The detection means scan the code surface of the pawn for detecting the pawn code when the pawn is positioned on the game board or when it is sufficiently near to the game board, such that the pawn code can be determined. Light provided by the display means is partly reflected by the code surface of the pawn. The detection means are arranged for detecting the reflected light and deriving a pawn code from the reflected light. The pattern, amount and wavelengths of the light that is reflected by the code surface depend on the code. The code may be either reflective or absorbing, as long as it can clearly be differentiated from the other parts of the code surface. Alternatively the pawns may be coded by providing different pawns with differently coloured code surfaces. The processor compares the detected code to codes from a set of codes, stored in a memory. When a match is found between the detected code and a stored code, the pawn is identified.

It is to be noted that MIT Media Lab has developed a metaDESK (see "The metaDESK: Models and Prototypes for Tangible User Interfaces", published in the Proceedings of UIST '97) which is not used for displaying a game board, but which is capable of recognizing objects on a desk. The largest component of the metaDESK is the desk itself, a back projected near-horizontal graphical surface used to display 2D geographical information. Several passive physical objects are manipulated by the user on the surface of the desk. Sensing in the system is provided by a computer vision system inside the desk unit, along with magnetic-field position sensors and electrical-contact sensors. The metaDESK, in contrast with systems using a camera above a desk, as described above, does not have the disadvantage that a user may impede the view of the camera. The metaDESK does, however, not solve the problems caused by the variations in ambient lighting. Another drawback of the metaDESK is the large size of the system due to the use of a back projection system and a video camera. In contrast in the present invention the scanning display, which comprises the combination of a display to display the game board layout and sensors, is relatively small and is less sensitive to ambient light, because the code is shielded by the pawn.

In an embodiment in accordance with the invention the display means comprise a plurality of light modulating cells and the detection means comprise a plurality of light sensors for scanning the code surface of the pawn, an individual light sensor of the plurality of light sensors being arranged adjacent to at least one individual light modulating cell of the plurality of light modulating cells. In an alternative embodiment a first layer comprising light modulating cells is stacked upon a second layer comprising light sensors.

For example, the light modulating cells in the scanning display are pixels of an LCD or organic LED display. In an LCD display the pixels transmit or block background or environmental light depending on a voltage applied to the cell. In such an LCD display, the sensing means may be light sensitive elements which are added to the cells or a sub group of the cells of the LCD display, or which are present in a separate stacked layer. The light sensitive elements, for example, are light dependent resistors (LDR) of which a resistance depends on the amount of light reaching the element, photodiode elements, or CCD or CMOS light sensor elements. Organic LEDs (OLEDS) emit light, depending on a current applied to the cell. Organic LEDs can be divided into two groups; Small Molecule OLEDs and Large Molecule OLEDs. Large Molecule OLEDs are also known as polymer LEDs.

An organic LED display may comprise organic LEDs which LEDs also function as light sensors. Polymer LED based displays with light detecting possibilities have been developed by PHILIPS and may be used as a scanning display for the game board according to the invention. The use of a scanning display based on polymer LEDs brings many advantages. For example, such displays are low weight, very flat and thin and offer high resolution, high brightness, high contrast and a large viewing angle. By the integration of the light modulating and light sensing functions in one combined cell, the number of required components for manufacturing a game board according to the invention is reduced.

In preferred embodiments of the game board according to the invention, the game board further comprises contact detection means for detecting a contact of the board surface with a contact surface of the pawn. In some board games it might be advantageous for the game board to be able to distinguish the situation of a pawn held just above the board surface by a user with the code surface directed towards the board surface from the situation of a pawn being placed at and in contact with the board surface. It is to be noted that the contact surface of the pawn may comprise the code surface.

The processor may also detect an orientation and/or a position of the pawn relative to the game board when the code surface is sufficiently close to and directed towards the board surface. The position of a pawn can be inferred from the positions of the light sensors, which detect the pawn code. If the shape of the contact surface of the pawn or of the code on the code surface is not completely symmetric the orientation of the pawn can also be inferred from the signals, supplied by the light sensitive elements. For most board games it is necessary that the positions of the pawns are known. The game situation does not only depend on which pawns are on the game board, but also on where the pawns are on the game board. In some board games it might be advantageous to also know the orientation of the pawns. In Stratego, for example, a game wherein only one player is allowed to see an image which is at only one side of the pawn, a warning signal can be provided when the orientation of the pawn is such that the other player might also see the image.

These and other aspects of the invention are apparent from and will be elucidated with reference to the embodiments described hereinafter.

BRIEF DESCRIPTION OF THE DRAWINGS

In the drawings:

FIG. 1 shows a schematic diagram of the system 1 according to the invention. The system 1 comprises a game board 2 and pawns 20. The game board 2 comprises a board surface 3 whereon various board games can be played. The game board 2 may comprise or is coupled to a processor 5, a memory 6 and a graphics generation unit 4 to display a game board layout according to a selected board game on the board surface 3. Well known examples of board games are Chess, Backgammon, Scrabble, and Monopoly. The system according to the invention does not only enable the playing of classical, known board games, but may also be used for completely new board games. Such new board games may include, for example, board games wherein the game board layout changes according to the run of the game. The board surface 3 may, for example be the surface of a display device, such as a LCD monitor, or a transparent plate covering such a display device. The memory 6, the processor 5 and the graphics generation unit 4 may be included in a personal computer (PC), coupled to the game board 2. The game board further comprises light sensors 12, for detecting light, reflected by a code surface of a pawn 20. In FIG. 1 the light sensors 12 are schematically indicated by a block 12, in practice the light sensors are present in the game board 2 near the board surface 3. Different embodiments and arrangements of these light sensors 12 will be described later on.

Figure 1:
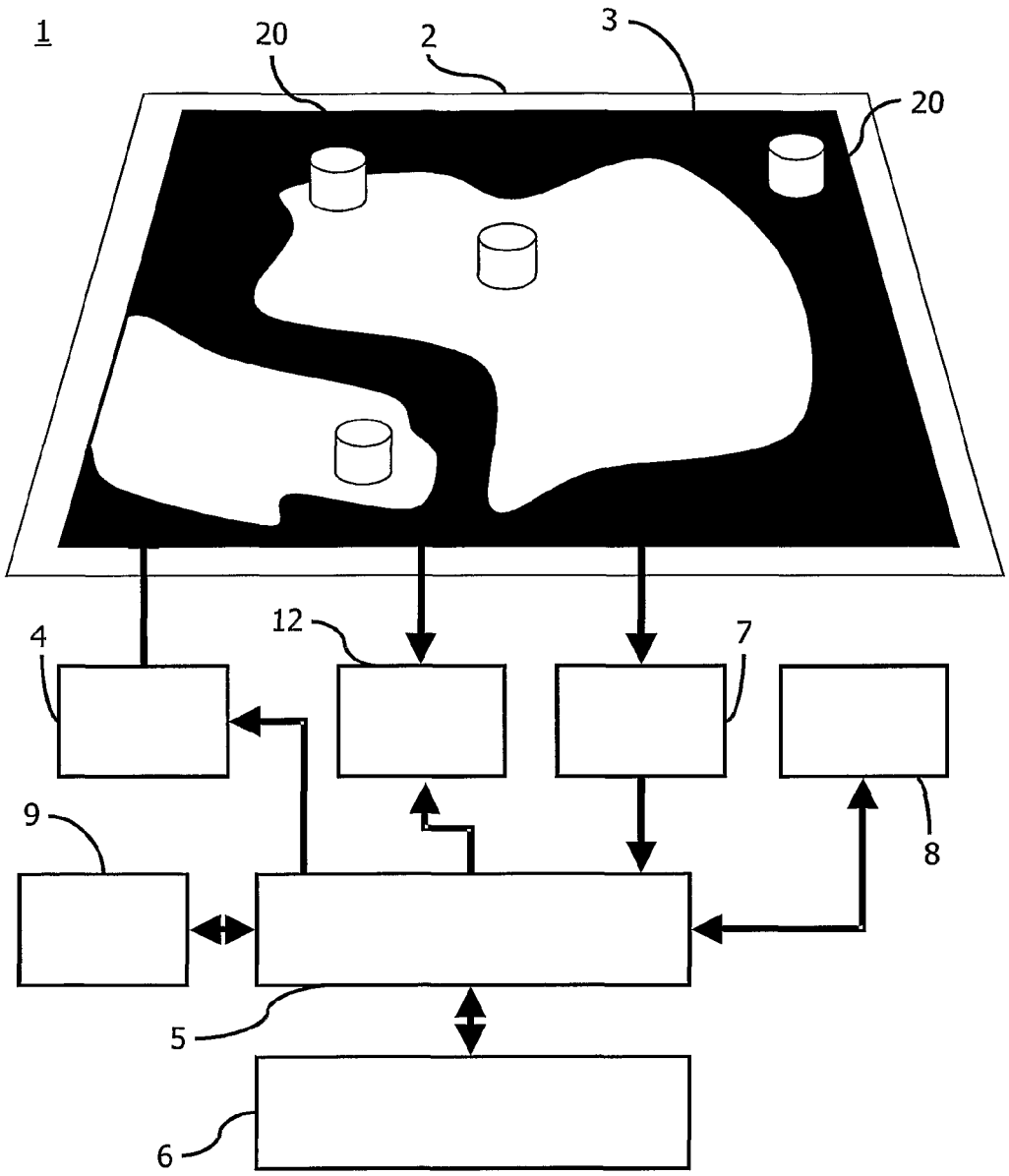
FIG. 1 shows a schematic diagram of the system according to the invention.

Preferably the system also comprises a user interface 8 to enable the user to select board games, start new games, save games, load previously saved games, choose playing modes etc. The user interface 8 may comprise well known devices, such as a keyboard, a mouse or a joystick. Alternatively, part of the board surface may function as a user interface 8 if the board surface is operative to detect a contact with a pointing object, such as a pen or a fingertip. The use of different types of touch screens for such user interfaces 8 is well known. Also the light sensors 12 may be used to detect a contact or a proximity of a pointing object to the board surface 3. The size and the elements of the user interface 8 may vary according to the game, game situation and/or available options. The system may comprise an Internet connection 9 which enables playing board games with or against other players from all over the world.

Signals, supplied by the light sensors 12 may be used to detect whether the pawn 20 is above or in contact with the board surface 3. Possibly, the game board also comprises a contact detection unit 7 for detecting a contact of a contact surface of the pawn 20 with the board surface 3. In some board games it might be advantageous for the game board 2 to be able to distinguish the situation of a pawn 20 being held just above the board surface 3 by a user with the code surface directed towards the board surface 3 from the situation of a pawn 20 being placed at and in contact with the board surface 3. The contact detection unit 7 may, for example, use well known touch screen techniques and may also be used for providing the user interface 8.

Many combinations of display and light sensing techniques may be used in the scanning display used in the game board 2 according to the invention. The display technique used for the scanning display may be any known display technique for televisions, personal, laptop or handheld computers, or other devices comprising a monitor. Preferably, a pixel based display is used with light sensors added to the pixels. Some examples of pixel based displays, used in the game board according to the invention, will be provided later on. Many types of known light sensors, like for example CCD or CMOS sensors as are often used in digital cameras, may be used as light sensing elements in the scanning display. The design of the game board 2 is such that the light reflected from the code surface of a pawn 20 can be detected by the light sensors and that a code can be identified by analyzing the light pattern detected by the light sensors. With respect to the prior art game system now the light sensors 12 and the display device are positioned very close to each other such that in fact, they form a single unit. It is much more reliable to detect a code on the code surface of the pawn 20 than to detect a shape of the pawn 20 with the prior art camera system.

Figure 2A:
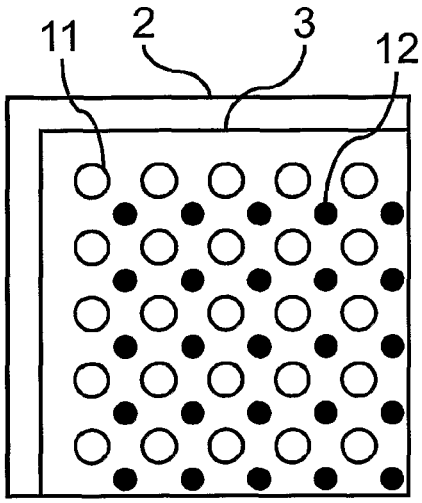
FIGS. 2*a* to 2*d* show exemplary arrangements of light modulating cells and light sensors in a game board according to the invention.
Figure 2B:
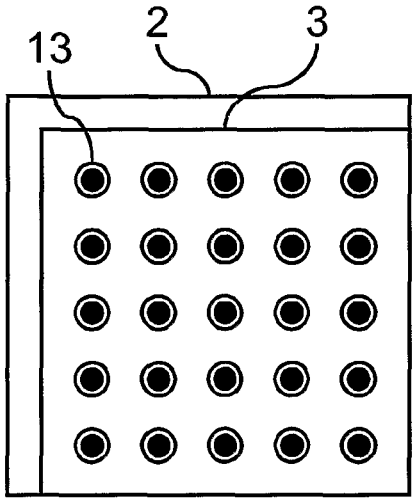
Figure 2C:
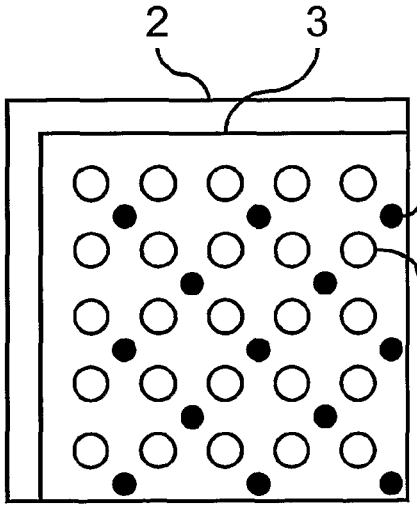
Figure 2D:
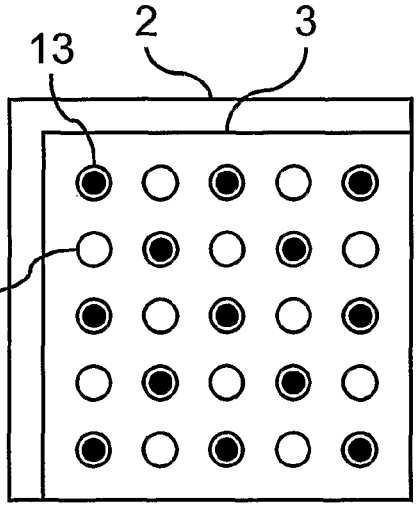

FIGS. 2*a* to 2*d* show exemplary arrangements of light modulating cells 11 and light sensors 12 in a game board 2 according to the invention. Preferably, the plurality of light modulating cells 11 is arranged in a grid, such as in an LCD display or an organic LED display. The scanning display further comprises a plurality of light sensors 12 for scanning the code surface of a pawn 20. An individual light sensor 12 of the plurality of light sensors 12 should be near to at least one light modulating cell 11 of the scanning display for being able to receive the light from said light modulating cell 11 after reflection at the code surface of a pawn 20. In FIG. 2*a* a light sensor 12 is provided next to each light modulating cell 11, the plurality of light sensors 12 thus forming a grid with a resolution equal to the resolution of the grid formed by the light modulating cells 11. In the scanning display shown in FIG. 2*b* the light sensors 12 are integrated in the light modulating cells 11 to form a combined light sensing/modulating cell 13. Such combined cells 13 may, for example, comprise polymer light emitting diodes (polyLED), which are capable of emitting as well as detecting light. FIGS. 2*c* and 2*d* show alternative arrangements of light modulating cells 11 and light sensors 12 in a game board 2. In the game boards 2 shown in FIGS. 2*c* and 2*d* the resolution of the grid formed by the light sensing cells 12 is lower than the resolution of the grid formed by the light modulating cells 11.

Figure 3:
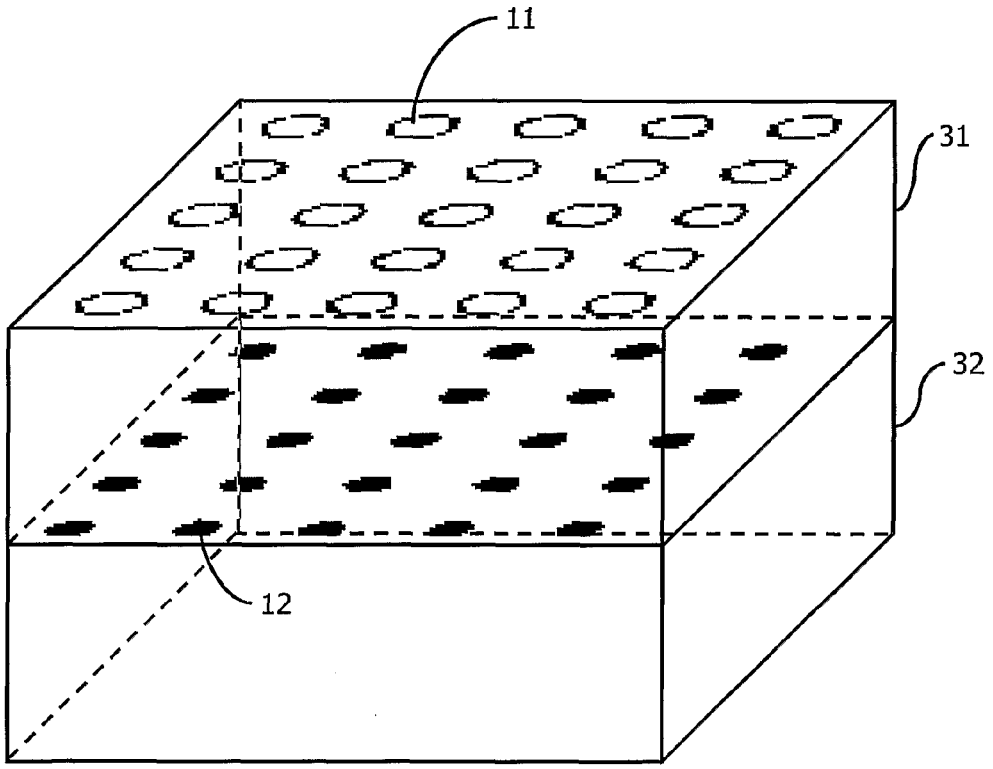
FIG. 3 shows an alternative embodiment of a game board according to the invention.

FIG. 3 shows an alternative embodiment of a game board according to the invention. In this embodiment the light modulating cells 11 and the light sensing cells 12 are comprised in a first layer 31 and a second layer 32, respectively. For the scanning display to work properly, the first layer 31 is at least partly transparent for enabling light reflected by the code surface of a pawn 20 to reach the second layer. The design of the game board 2 is such that most light reaching the light sensors 12 comes directly from the code surface of the pawn 20. Light coming directly from the light modulating cells 11, or via internal reflections in the game board 2, may impair the capability of the game board 2 to detect codes on the code surface of pawns 20. In FIG. 3, the light modulating layer 31 is stacked upon the light sensing layer 32. Alternatively, the light sensing layer 32 may be stacked upon the light emitting layer 31. In this event, the light sensing layer 32 is partly transparent for enabling the game board lay out to be displayed on the board surface 3 and the light sensors 12 are not sensitive for light coming directly from the light modulating cells 11. Only light reflected at the code surfaces of the pawns 20 should be detected by the light sensors 12.

Figure 4A:
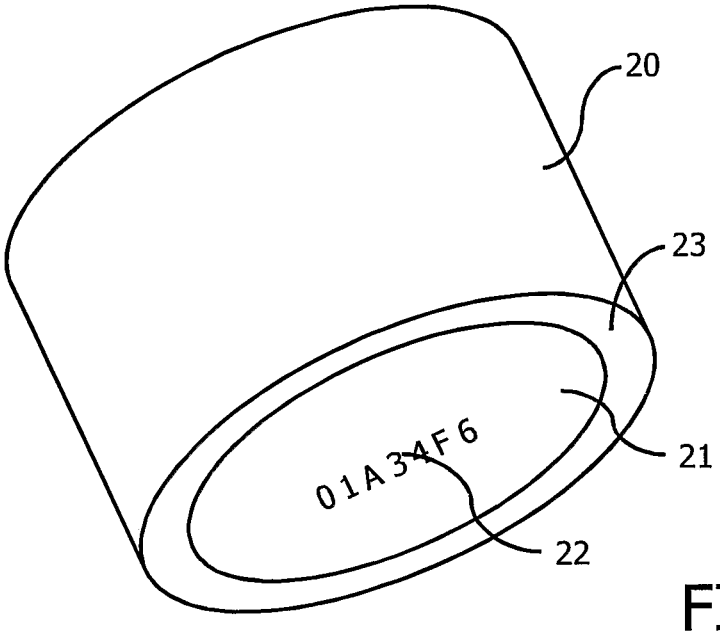
FIGS. 4*a*, 4*b* and 4*c* show embodiments of pawns according to the invention.
Figure 4B:
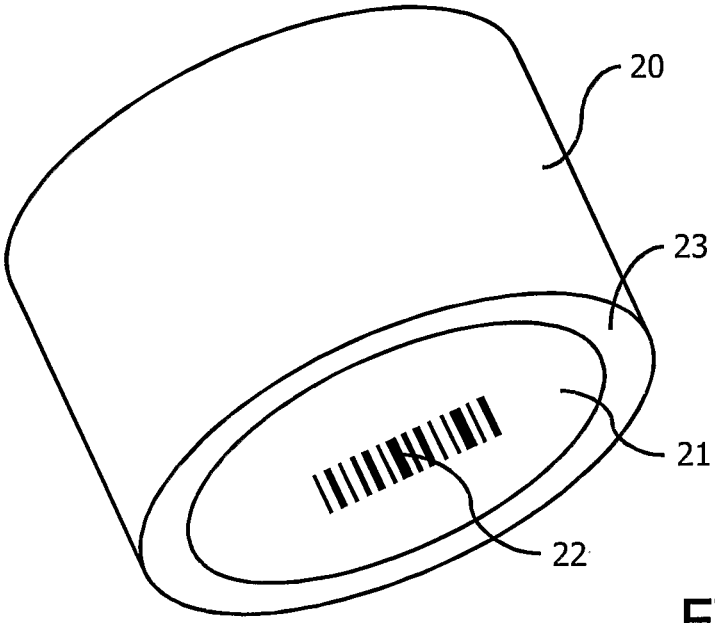
Figure 4C:
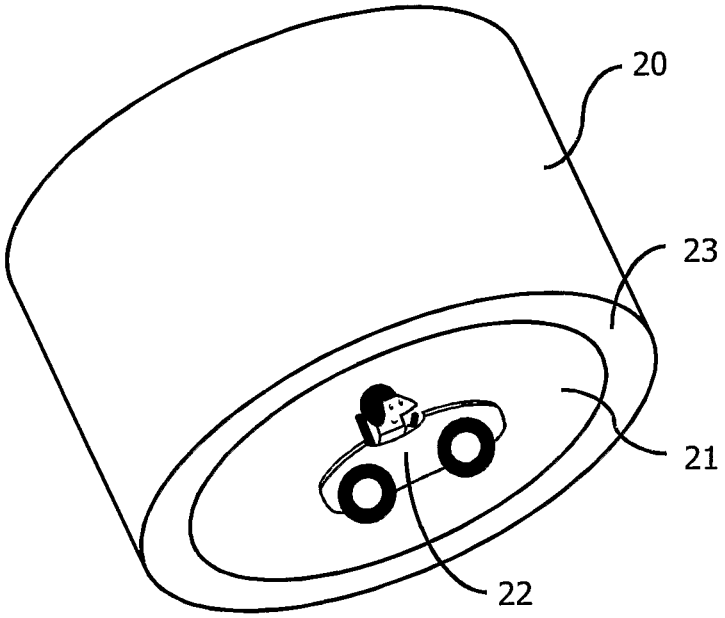

FIGS. 4*a*, 4*b* and 4*c* show embodiments of pawns 20 according to the invention. All figures show a pawn 20 with a contact surface 23 comprising the code surface 21. In FIG. 4*a* the code 22 on the code surface 21 comprises characters. In FIG. 4*b* the code 22 comprises a bar code. Other coding systems based on visual contrast between a background colour and a colour of a foreground image may be used. For example, pictograms or differently shaped or sized polygons may be used as a code 22. In FIG. 4*c* a pawn 20 is shown, with a code 22, comprising a pictogram. If the game board is operative to detect the colour of the light reflected by the code surface 21, a colour scheme may be used for coding the different pawns 20.

Alternatively a code sticker may be provided for applying to a pawn. The sticker may be used for coding a set of normal pawns without a code. The coded pawns may then be used with the game board 2 according to the invention, and will be recognized by the game board 2. The sticker may also be used for recoding pawns, which already have a code. Recoding may, for example, be required when a pawn from a first set of pawns comprises a code which is identical to a code of a pawn from a second set of pawns and both sets are to be used together for playing a game.

When the pawn 20 is placed on or held just above the board surface 3 with its code surface 21 directed towards the board surface, the light sensors detect the light reflected at the code surface. The wavelengths and the intensities of the reflected light depend on the code 22 on the code surface 21. Darker parts of the code surface 21 reflect less visual light than lighter parts. The information about the reflected light, detected by the light sensors 12 is analyzed by the processor 5, for identifying and locating the pawn which is represented by the detected code 22. If the code is not completely symmetric, the processor may also derive an orientation of the pawn 20 from the light detected by the light sensors 12.

Figure 5:
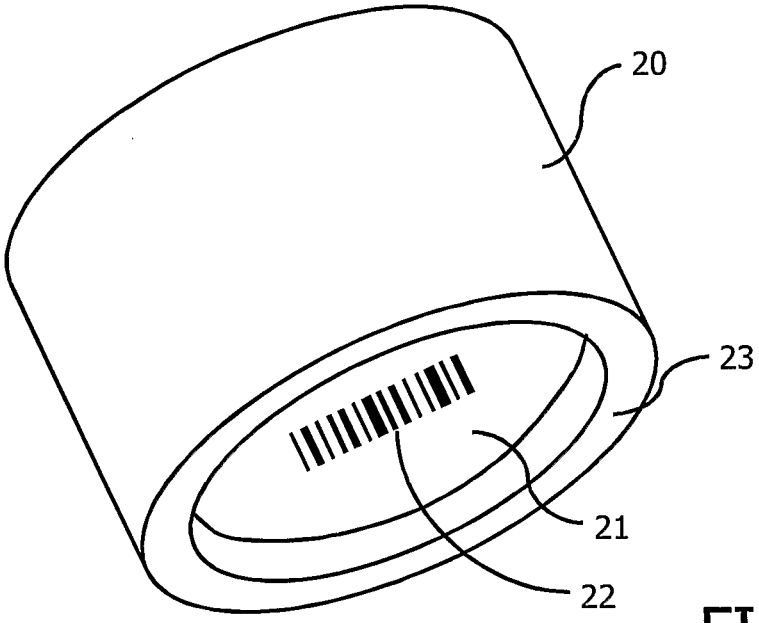
FIG. 5 shows an alternative embodiment of a pawn according to the invention.

FIG. 5 shows an alternative embodiment of a pawn according to the invention. The contact surface 23 of the pawn 20 shown in FIG. 5 does not comprise the code surface 21. When placed on the board surface 3, the code surface 21 of the pawn 20 is just above and directed towards the board surface 3.

Figure 6:
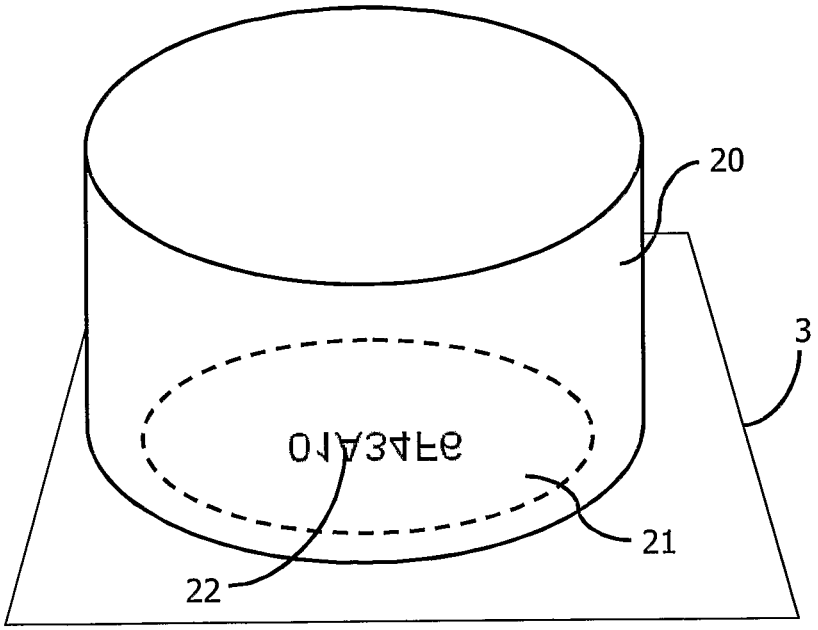
FIG. 6 shows an embodiment of a pawn according to the invention, placed on a game board.

FIG. 6 shows an embodiment of a pawn according to the invention, placed on a game board 2. When placed on the game board 2, the code surface 21 is obscured from the view of the player. Part of the light emitted by the display, for showing a game board layout on the board surface 3, is reflected by the code surface 21 and used for identifying the pawn 20.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A game board comprising:

a board surface;

a plurality of pawns each having a unique code;

a scanning display configured to display a game layout on the board surface; and a detector configured to detect the code when the pawn is held above the board surface, and when the pawn is in contact with the board surface, detect an orientation of the pawn relative to the game board when the pawn is sufficiently close to the board surface, and provide a warning when the orientation of the pawn is inappropriate.

2. The game board as claimed in claim 1, further comprising:

a memory for storing the plurality of codes; and a processor for comparing the detected code to at least one of the stored codes.

3. The game board as claimed in claim 1, wherein the scanning display includes a plurality of light modulating cells and the detector includes a plurality of light sensors for scanning for the code, each of the plurality of light sensors being adjacent to at least one of the plurality of light modulating cells.

4. The game board as claimed in claim 1, wherein the scanning display comprises a first layer including a plurality of light modulating cells for displaying the game board layout and a second layer including a plurality of light sensors for scanning for the code, the first layer and the second layer are stacked.

5. The game board as claimed in claim 3, wherein the light modulating cells are pixels of an LCD display.

6. The game board as claimed in claim 3, wherein the light modulating cells are pixels of an organic LED display.

7. The game board as claimed in claim 1, wherein the scanning display comprises a plurality of cells configured to modulate light for displaying the game layout, and sensing light for scanning for the code.

8. The game board as claimed in claim 7, wherein the cells comprise organic LEDs.

9. The game board as claimed in claim 1, further comprising a contact detector for detecting a contact of the board surface with the pawn.

10. The game board as claimed in claim 2, wherein the processor is arranged for detecting a position of the pawn when the code surface is directed towards the board surface.

11. The game board as claimed in claim 2, wherein the processor is configured to detect an orientation of the pawn relative to the game board when the code is directed towards the board surface.

* * * * *